US010526709B2

(12) United States Patent
Naruskevicius et al.

(10) Patent No.: US 10,526,709 B2
(45) Date of Patent: Jan. 7, 2020

(54) PRETREATMENT OF PLASTIC SURFACES FOR METALLIZATION TO IMPROVE ADHESION

(71) Applicant: VMTI FIZINIU IR TECHNOLOGIJOS MOKSLU CENTRAS, Vilnius (LT)

(72) Inventors: Leonas Naruskevicius, Vilnius (LT); Mark Hyman, Oxnard, CA (US)

(73) Assignees: VMTI FIZINIU IR TECHNOLOGIJOS MOKSLU CENTRAS, Vilnius (LT); Mark Hyman, Oxnard, CA (US); UAB "REKIN INTERNATIONAL", Vilnius (LT)

( * ) Notice: Subject to any disclaimer, the term of this patent is extended or adjusted under 35 U.S.C. 154(b) by 0 days.

(21) Appl. No.: 16/063,509

(22) PCT Filed: Nov. 15, 2016

(86) PCT No.: PCT/IB2016/056858
§ 371 (c)(1),
(2) Date: Jun. 18, 2018

(87) PCT Pub. No.: WO2017/103706
PCT Pub. Date: Jun. 22, 2017

(65) Prior Publication Data

US 2019/0003057 A1 Jan. 3, 2019

(30) Foreign Application Priority Data

Dec. 18, 2015 (LT) ..... 2015 105

(51) Int. Cl.
*C23C 18/24* (2006.01)
*C23C 18/32* (2006.01)
*C25D 5/56* (2006.01)

(52) U.S. Cl.
CPC ..... *C23C 18/24* (2013.01); *C23C 18/32* (2013.01); *C25D 5/56* (2013.01)

(58) Field of Classification Search
CPC ..... C23C 18/24; C23C 18/32; C23C 18/22; C25D 5/56
See application file for complete search history.

(56) References Cited

U.S. PATENT DOCUMENTS

| | | | | |
|---|---|---|---|---|
| 2009/0176022 | A1 | 7/2009 | Shimizu | |
| 2015/0017331 | A1 | 1/2015 | Middeke et al. | |
| 2017/0166812 | A1* | 6/2017 | Middeke | C25D 5/56 |

FOREIGN PATENT DOCUMENTS

| | | | | |
|---|---|---|---|---|
| WO | WO-2015150156 | A1 * | 10/2015 | C25D 5/56 |

OTHER PUBLICATIONS

International Search Report and Written Opinion in International Application No. PCT/IB2016/056858, dated Jun. 22, 2017.

* cited by examiner

*Primary Examiner* — Nadine G Norton
*Assistant Examiner* — Mahmoud Dahimene
(74) *Attorney, Agent, or Firm* — Foley & Lardner LLP

(57) ABSTRACT

The present invention relates to the adhesional pretreatment of plastics surface prior to their metallization by chemical or electrochemical methods and may be used in those industrial fields where decorative or functional metallic coatings on top of the plastic surfaces are needed. The purpose of the proposed invention is a high-quality adhesional pretreatment of plastic surface prior to metallization. The purpose is achieved by treating the plastic before to etch it 5-15 min at 50-70° C. in the alcaline permanganic solution containing 1-3M NaOH and 0.1-0.5 M permanganate ions and acidic permanganic etching solution additionally contains 0.5-8.0 M of copper nitrate and the etching is performed at room temperature during 5-60 min.

15 Claims, No Drawings

PRETREATMENT OF PLASTIC SURFACES FOR METALLIZATION TO IMPROVE ADHESION

FIELD OF THE INVENTION

The present invention relates to the adhesional pretreatment of plastics surface prior to their metallization by chemical or electrochemical methods and may be used in those industrial fields where decorative or functional metallic coatings on top of the plastic surfaces are needed.

BACKGROUND ART

A conventional method of plastic surface pretreatment prior to metallization consist of etching the surface with solution containing permanganate or other Mn ions which are the etchants-oxydizers. Permanganate as oxidizing agent is commonly proposed to be used in the acidic media, because only in this case the surfaces of acrylo-nitryl-butadien-styrene copolymere (ABS), ABS mixed with polycarbonate (PC/ABS), polyetherimides (PEI) and polyetheretherketones (PEEK) are able to be modified during the etching with certain functional groups allowing to obtain good metal adhesion with said plastics (U.S. Pat. No. 3,647,699A, 1970; US20040096584A1, 2003; WO2005094394A2, 2005; US20090176022A1, 2006; US20110140035A1, 2007; U.S. Pat. No. 9,023,228B2, 2008; EP2825689A1, 2013).

The main shortcoming of the above mentioned methods is that the stability of permanganate ions in the acidic media is enough limited, especially if such media contains strong (sulphuric, nitric, chlorate) inorganic acids. Even phosphoric acid with concentration more than 45% (vol) compared to the rest of the water is not recommended (US20050199587A1, 2004; WO2005094394A2, 2005). However, if the etcher contains just phosphoric acid with concentration not exceeding 50 vol %, the oxidizing properties of the permanganate ions at a room temperature are too weak for many plastics including mentioned above. Therefor the such etcher can work properly just at temperature, at least up to 50-60° C. However, the stability of permanganate ions greatly reduces at elevated temperature (accelerates their decomposition reaction, releasing the oxygen) therefore the concentration of permanganate ions decreases rapidly to unacceptable limits and, despite the etchers higher temperature, it becomes unable to modify chemically the plastic's surface properly (US20050199587A1, 2004; U.S. Pat. No. 9,023,228B2, 2008).

It is also a known method of using a strongly acidic media to stabilize permanganate ions (WO2014124773A2, 2014). This method is based on the fact, that enough concentrated sulphuric acid forms strong complex compound with permanganate ions. However, highly concentrated sulphuric acid chemically intensively reacts with many plastics, in particular PEEK, destroying plastic's surface structure. Thus, it is impossible to get a good coating adhesion to plastics using such conditions. In addition, the permanganate ions tend to form insoluble $Mn_2O_7$ in concentrated sulphuric acid, which remains on the etcher's surface. $Mn_2O_7$ is extremely strong oxidizer, which in contact with the organic compounds can be self-ignite or even cause an explosions.

The method for plastics surface pretreatment comprising etching of the surface with permanganate ions in the solution of phosphoric acid which contains also nitric acid (US20090176022A1, 2006) is the closest to the proposed invention. Nitric acid enhances the efficiency of the etcher and enables to obtain good adhesion of metallic coating to plastics etching at room temperature. However, even under such conditions, nitric acid, being a strong inorganic acid, considerably accelerates the self-decomposition of the permanganate ions and the problem of the etcher's stability remains unsolved.

SUMMARY OF THE INVENTION

The purpose of the proposed invention is a high-quality adhesional pretreatment of plastic surface prior to metallization.

The purpose is achieved by treating the plastic before to etch it 5-15 min at 50-70° C. in the alcaline permanganic solution containing 1-3M NaOH and 0.1-0.5 M permanganate ions and acidic permanganic etching solution additionally contains 0.5-8.0 M of copper nitrate and the etching is performed at room temperature during 5-60 min.

Alcaline permanganic solution is completely stable at 60° C. and higher temperatures, so it can be exploited a long time without adjustments. Experimental results are showing that advance maintaining of ABS or PC/ABS plastics in alcaline permanganic solution enhances the adhesion of obtained metallic coatings to plastic by up to 50%. If same plastics are maintained in the solution longer than 5 minutes, or solution's temperature is higher than 60° C., or the concentration of ingredients in the solution is higher than indicated above coatings adhesion to plastics is not higher, however, substantial reduction of these parameters can negatively influence the adhesion. For example, when reducing the concentration of NaOH in the solution to 0.01 M the result is such, that maintaining in the alcaline solution does not increase adhesion.

After the plastic is finished to maintain in alcaline permanganic solution—it is taken off, washed and dipped into acidic permanganic etcher of room temperature, the latter consisting of phosphoric acid (1-6 M), permanganate of alcaline metal (0.1-0.5 M) and copper nitrate (0.5-8.0 M), the rest—water. Plastic is maintained 5 to 60 min. in the acidic permanganic etching solution. Best maintaining time depends on the plastic's nature. It is enough 5-20 min. for ABS and PC/ABS plastics, while PEI or PEEK are etched much longer. The etching solution is free of strong inorganic acids, so even if the etching time exceeds the recommended, there is no risk of overetching. After the etching the plastic is washed up with water and then plated with the first layer of metal (usually Ni) using electroless (autocatalysis) or electrolytic (electroconducting underlayers) methods.

Copper nitrate is unique additive for the acidic permanganic etcher based on phosphoric acid since achieved adhesion results were not reached again by attempt to change ions of copper or nitrate or both at once by any other ions. The effectiveness of room temperature etcher is increased so much by adding the copper nitrate, that the etcher can even be used without pretreatment in alcaline permanganic solution. The obtained adhesion values in this case are somewhat smaller, than those obtained using the pretreatment in alcaline permanganic solution. In case of dissolving bigger amounts of copper nitrate in the etching solution, the concentration of phosphoric acid in the etcher can even be substantially reduced, the etcher still remaining effective. The bigger the concentration of $Cu(NO_3)_2$ in the solution—the less concentration of $H_3PO_4$ is acceptable in it, and, as a consequence, more stability of the permanganate ions is reached.

EXAMPLES OF EMBODIMENT

Plastics ABS, PC/ABS, PEI (with glass fibre filling), PEEK (with carbon fibre filling) which have flat surface of at least 1×4 cm are maintained at 60° C. for 5 minutes in alcaline permanganic solution consisting of 1 M NaOH, 0.4 M $KMnO_4$, the rest—water. Further the plastics are washed under tap water (if they were maintained in alcaline permanganic solution) and are dipped for 5-60 min into acidic permanganic etcher of room temperature consisting of 2-6 M $H_3PO_4$, 0-8.0M $Cu(NO_3)_2$, 0.2-0.5M $KMnO_4$, the rest—water. After the etching the plastics are activated for 5 minutes at room temperature in the 0.2 M solution of $CoSO_4$, which is of pH near 6.0, then are washed with water and then are dipped for 0.5 minutes into 0.2 M solution of $Na_2S$ of room temperature. After that the plastics again are washed with water and further are plated with 1-2 mkm thick Ni layer electrolytically in Wat's bath at standard conditions. Or after etching the plastics are activated during 1-2 minutes in room temperature solution containing 0.001 M $PdCl_2$ and 0.3 ml/L HCl, then are washed with water and maintained 5 minutes in 0.2M $NaHPO_2$ solution at 50° C. After that the plastics are plated electrolessly (autocatalysis) at 35° C. during 15 min in the solution containing (M): $NiSO_4$—0.1; Na citrate—0.1; $NaHPO_2$—0.2; $NH_3$—to solution's pH 8.8. In order to measure the adhesion of Ni coating deposited electrolessly or electrolytically the Ni coating is further plated with copper electrolytically to reach total thickness 50 mkm in the solution (M): $CuSO_4$—1.5; $H_2SO_4$—2.0, rest—water. To evaluate Ni coating's adhesion to plastic the force needed to peel off 1 cm wide strip of the coating at right angle is measured. Conditions of the plastic's adhesional pretreatment and the values of Ni coating adhesion obtained as a consequence of pretreatment are given in the Table. Effect of ABS advance maintaining in the alcaline permanganic solution and of copper nitrate adding to acidic permanganic etcher on coating's adhesion is seen comparing examples 1, 2, 4. Example 3 is showing that the minimum concentration of $Cu(NO_3)_2$=0.5 M in the etching solution even though less effective, however it still helps to obtain coating's adhesion to ABS adequate for practice. Comparing examples 2 and 5 we can ascertain that the adhesion of Ni coating is independent of the method how Ni coating is obtained. Examples 5 and 6 are testifying that the effectiveness of the etching solution is rising sharply if the increase of $Cu(NO_3)$ in it is considerable even in the case of lower $H_3PO_4$ concentration. Comparing examples 6 and 7 we note positive influence of maintaining time in the etching solution to the Ni coating's adhesion with ABS. Same law is characteristic for PC/ABS plastic (examples 8-12). In case of PEI and PEEK plastics (examples 13-19) in contrast to ABS and PC/ABS plastics,—advance maintaining in an alcaline permanganic solution does not rise adhesion values, thus is not needed. However Ni coating's adhesion values to PEEK are very dependant on the fact, whether the etching solution is containing $Cu(NO_3)_2$ and how much of it (examples 17-19).

TABLE

| Example No. | Plastic | Alcaline permanganic solution: Used (+)/ Not Used (−) | Acidic permanganic etchant, (M): $H_3PO_4$ | $CU(NO_3)_2$ | $KMnO_4$ | Etching time, min. | First Ni layer: electroless (e-less)/ electrolytic (e-lytic) | Adhesion, kN/m |
|---|---|---|---|---|---|---|---|---|
| 1 | ABS | − | 6 | 0 | 0.2 | 10 | e-less | 0 |
| 2 | ABS | + | 6 | 2 | 0.2 | 10 | e-less | 1.5 |
| 3 | ABS | + | 6 | 0.5 | 0.2 | 10 | e-less | 0.5 |
| 4 | ABS | − | 6 | 2 | 0.2 | 10 | e-less | 1.0 |
| 5 | ABS | + | 6 | 2 | 0.2 | 10 | e-lytic | 1.5 |
| 6 | ABS | + | 2 | 7 | 0.2 | 10 | e-lytic | 1.8 |
| 7 | ABS | + | 2 | 7 | 0.2 | 5 | e-lytic | 1.4 |
| 8 | PC/ABS | − | 6 | 2 | 0.2 | 15 | e-lytic | 0.4 |
| 9 | PC/ABS | + | 6 | 2 | 0.2 | 15 | e-lytic | 0.6 |
| 10 | PC/ABS | + | 2 | 7 | 0.2 | 15 | e-lytic | 0.7 |
| 11 | PC/ABS | + | 6 | 0 | 0.2 | 15 | e-lytic | 0 |
| 12 | PC/ABS | + | 2 | 7 | 0.2 | 5 | e-lytic | 0.5 |
| 13 | PEI | − | 2 | 8 | 0.5 | 60 | e-lytic | 0.8 |
| 14 | PEI | + | 2 | 8 | 0.5 | 60 | e-lytic | 0.8 |
| 15 | PEI | − | 2 | 8 | 0.5 | 10 | e-lytic | 0.2 |
| 16 | PEEK | + | 2 | 8 | 0.5 | 60 | e-less | 2.4 |
| 17 | PEEK | − | 2 | 8 | 0.5 | 60 | e-lytic | 2.4 |
| 18 | PEEK | − | 6 | 0 | 0.5 | 60 | e-lytic | 0 |
| 19 | PEEK | − | 6 | 1 | 0.5 | 60 | e-lytic | 0.6 |

The invention claimed is:

1. A method for pretreatment of a plastic surface for metallization, the method comprising:

contacting the plastic surface with a first aqueous solution comprising 1M to 3M NaOH and 0.1 to 0.5 M $MnO_4^-$ at a temperature of 50° C. to 70° C.;

removing the plastic surface from the first aqueous solution as a treated plastic surface;

contacting at room temperature the treated plastic surface with a second aqueous solution comprising an acid, $Cu(NO_3)_2$, and $MnO_4^-$ to form an etched plastic surface.

2. The method of claim 1, wherein the $Cu(NO_3)_2$ is present in the second aqueous solution at 0.5 M to 8.0 M.

3. The method of claim 1, wherein the $MnO_4^-$ is present in the second aqueous solution at 0.2 M to 0.5 M.

4. The method of claim 1, wherein the $MnO_4^-$ is present in the first aqueous solution as $KMnO_4$.

5. The method of claim 1, wherein the $MnO_4^-$ is present in the second aqueous solution as $KMnO_4$.

6. The method of claim 1 further comprising washing the treated plastic surface with water prior to contacting with the second aqueous solution.

7. The method of claim 1 further comprising washing the etched plastic surface with water.

8. The method of claim 1, wherein the acid is $H_3PO_4$.

9. The method of claim 8, wherein $H_3PO_4$ is present in the second aqueous solution at 2M to 6M.

10. The method of claim 1 further comprising contacting the etched plastic surface with a third aqueous solution comprising $CuSO_4$ to form an activated plastic surface.

11. The method of claim 10, wherein the third aqueous solution comprises about 0.2 M $CuSO_4$ at a pH of about 6.

12. The method of claim 10 further comprising contacting the activated plastic surface with a fourth aqueous solution comprising $Na_2S$.

13. The method of claim 12 further comprising contacting the etched plastic surface with a fifth aqueous solution comprising $PdCl_2$ and HCl.

14. The method of claim 1, wherein the contacting of the plastic surface with the first aqueous solution is conducted for 5 minutes to 15 minutes.

15. The method of claim 1, wherein the contacting at room temperature is conducted for 5 minutes to 60 minutes.

* * * * *